United States Patent [19]

Wilson

[11] 4,293,305

[45] Oct. 6, 1981

[54] DIESTER COMPOSITION AND TEXTILE PROCESSING COMPOSITIONS THEREFROM

[75] Inventor: Robert B. Wilson, Greenville, S.C.

[73] Assignee: Northwestern Laboratories, Inc., Greenville, S.C.

[21] Appl. No.: 203,636

[22] Filed: Nov. 3, 1980

Related U.S. Application Data

[63] Continuation-in-part of Ser. No. 90,092, Nov. 1, 1979.

[51] Int. Cl.[3] ..... D06M 1/00

[52] U.S. Cl. ..... 8/115.6; 8/116 P; 8/922; 252/8.6; 252/8.9; 260/97.5; 428/265; 428/395; 560/128

[58] Field of Search ..... 8/115.6, 116 P; 252/8.6, 8.9; 428/265, 395; 260/97.5; 560/128

[56] References Cited

U.S. PATENT DOCUMENTS

| | | | |
|---|---|---|---|
| 3,329,633 | 7/1967 | Crovatt | 8/115.6 |
| 3,694,257 | 9/1972 | Dumont | 428/262 |
| 3,753,968 | 8/1973 | Ward | 260/97.5 |
| 3,899,476 | 8/1975 | Ward | 260/97.5 |
| 3,925,589 | 12/1975 | Sturwold et al. | 528/491 |
| 3,950,419 | 4/1976 | Baumann et al. | [illegible] |
| 4,135,878 | 1/1979 | Bishop et al. | 8/115.6 |

OTHER PUBLICATIONS

Ward, B. F. et al., J. Amer. Oil Chemists' Soc., 1975, 52, (No. 7), pp. 219–224.

Teeter, H. M. et al., J. Organic Chemistry, 1957, 22, 512–514.

Danzig, M. J. et al., J. Amer. Oil Chemists' Soc., 1957, 34, pp. 136–138.

Teeter, H. M. et al., J. Amer. Oil Chemists' Soc., 1938, 35, pp. 238–240.

*Primary Examiner*—A. Lionel Clingman

*Attorney, Agent, or Firm*—Bailey, Dority & Flint

[57] ABSTRACT

A cycloaliphatic diester of the formula wherein

R is straight or branched chain alkyl of 4-20 carbon atoms, polyoxyalkylene of the formula $HO(CH_2CH_2O)_nCH_2CH_2$—, $HO(C_3H_6O)_nC_6H_3$—, $HO(CH_2CH_2O)_p(C_3H_6O)_qC_3H_6$—, or $HO(C_3H_6O)_p(C_2H_4O)_qC_2H_4$— or phosphated polyoxyalkylene, wherein n is 2-22 and the sum of p+q is n, in combination with a high boiling aromatic ester, is useful in fiber treating and textile processing compositions.

5 Claims, 4 Drawing Figures

CONVENTIONAL SPIN FINISH
(200X)

CONVENTIONAL SPIN FINISH
(200X)

FINISH OF EXAMPLE 15
(200X)

CONVENTIONAL SPIN FINISH
(400X)

FINISH OF EXAMPLE 15
(400X)

DIESTER COMPOSITION AND TEXTILE PROCESSING COMPOSITIONS THEREFROM

REFERENCE TO RELATED APPLICATIONS

This is a continuation-in-part of Ser. No. 090,092, filed Nov. 1, 1979.

BACKGROUND OF THE INVENTION

This invention relates to a combination of cycloaliphatic diesters and high boiling aromatic esters and their use in fiber-treating and textile processing compositions.

PRIOR ART STATEMENT

It has been proposed by Sturwold et al, in U.S. Pat. No. 3,925,589, to use emulsions of esters derived from polyoxy-alkylene glycols of molecular weight 300–4000 and a dibasic acid mixture of a dimer acid of 32–54 carbon atoms and a short chain dibasic acid of 2–12 carbon atoms for lubricating polyamide fibers.

Dumont, in U.S. Pat. No. 3,694,257, has proposed the use of polyesters prepared from reaction of polyols with a di- or tribasic acid as textile assistants for softening textile fabrics.

It has been proposed by Crovatt, Jr., in U.S. Pat. No. 3,329,633, to improve the lubricity of polyhexamethylene adipamide fibers by adding 0.1–5.0% by weight of oleic acid dimer to the polymer during the final polymerization stage thereof.

Bishop et al, in U.S. Pat. No. 4,135,878, has disclosed inclusion of up to 10% by weight of a dimer acid in an emulsifier-solvent scour composition used for treating textile materials under alkaline conditions.

Preparations of adducts from conjugated octadecadienoic acid and unsaturated acids and/or their hydrogenation has been described by Teeter et al, J. Org. Chem., vol. 22 (1957) at 512–514, Ward in U.S. Pat. No. 3,899,476 and Ward et al in U.S. Pat. No. 3,981,682.

The preparation of esters from the $C_{21}$ diacid adduct was reported by Ward et al, J. Amer. Oil Chemists' Soc., vol. 57 (1975) at 219–224. Ethoxylated esters containing 4–119 ethylene oxide units are said to be particularly effective lime soap dispersants. The alkyl esters are reported as being particularly useful in lubricant applications, including uses as textile lubricants and plasticizers for PVC.

The use of lower aromatic esters in textile treatment, particularly as dyeing assistants is well known, as is disclosed in U.S. Pat. Nos.: 2,880,050 Fortress et al; 2,881,045 Mecco et al; 3,036,876 Schoellig et al; 3,124,412 Fidell et al; 3,929,407 Parker; 3,932,128 Beaulieu.

References which disclose the use of phthalate esters in dyeing processes include U.S. Pat. Nos.: 2,833,613 Hallada et al; 2,934,397 Landerl; 2,982,597 Salvin et al; 3,667,899 Harnett et al; 3,973,907 Forschirm; 4,032,291 Dellian.

Phthalate esters have been used as components of lubricants for textiles, for example, by Jaeger (U.S. Pat. No. 2,212,369), Dickey et al (U.S. Pat. No. 2,241,246), Brennan et al (U.S. Pat. No. 2,882,231) and Iyengar et al (U.S. Pat. No. 3,853,607).

The use of hydroxyalkyl or alkoxyalkyl benzoates as dyeing assistants or fixatives is disclosed by Fuhr et al (U.S. Pat. No. 3,532,454), Baumann et al (U.S. Pat. No. 3,950,419) and Lazar et al (U.S. Pat. No. 3,917,447).

Higher trialkyl trimellitates have been proposed by Hinton, Jr. et al as components of a soil release composition (U.S. Pat. No. 3,824,125).

OBJECT OF THE INVENTION

It is an object of the invention to provide a novel combination of cycloaliphatic and high boiling aromatic esters which, used as ingredients of textile-processing agents, particularly for polyester fibers, eliminates one or more otherwise conventional processing steps without impairing the ultimate properties of the fiber treated therewith.

SUMMARY OF THE INVENTION

In one aspect of this invention, cycloaliphatic diesters of the formula

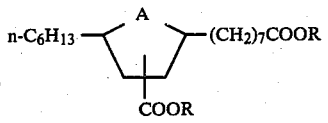

wherein A is $—CH_2—CH_2—$ and R is straight or branched chain alkyl of 4–20 carbon atoms, polyoxyalkylene of the formula $HO(C_xH_yO)_nC_xH_y—$ or phosphated polyoxyalkylene of the formula $$(HO)_2\overset{\overset{\displaystyle O}{\|}}{P}—O(C_xH_yO)_nC_xH_y$$

or a salt thereof wherein $(C_xH_yO)_n$ is $(CH_2CH_2O)_n$, $(C_3H_6O)_n$ or $(CH_2CH_2O)_p(C_3H_6O)_q$ and n is 2–22 are combined with a high boiling aromatic ester of the formula $ArCOO\text{-}R_1\text{-}OOCAr$ or $ArCOOR_2$, wherein Ar is monocyclic aryl of up to 10 carbon atoms; $R_1$ is alkylene of up to 8 carbon atoms, or polyoxyalkylene of the formula $—C_rH_{2r}(O\text{-}C_rH_{2r})_s$ in which r is 2 or 3 and s is up to 15; and $R_2$ is alkyl or alkenyl of 8–30 carbon atoms, to provide a base for a multi-purpose fiber and textile-treating composition.

This invention further relates to a synthetic fiber or fabric coated with a treating-agent containing the foregoing composition.

This invention further relates in the conversion of synthetic fibers to piece goods and subsequent dyeing, to the improvement wherein a composition of this invention is the sole fiber-treating agent used.

This invention also relates to a method of making fabric or an article from a synthetic fiber or fabric comprising coating the fiber or fabric with 1–2% by weight of a knitting or weaving lubricant comprising 5–15 parts by weight of cycloaliphatic diester, 30–50 parts by weight of high boiling aromatic ester, 5–15 parts by weight of dye-levelling agent and 10–30 parts by weight of emulsifiers, dispersing agents and/or anti-static agents; knitting or weaving the fiber into fabric or a knitted or woven article and dyeing the fabric or knit or woven article.

This invention further relates to a method for treating a synthetic fiber comprising applying to the fiber to a pick-up of 0.4–0.75% by weight a spin finish comprising (1) a cycloaliphatic diester, (2) a high boiling aromatic diester and (3) a dye-levelling agent; texturing the thus-coated synthetic fiber at 180°–230° C.; knitting or weaving the resulting textured fiber into fabric or knitting the textured fiber into a knit article and dyeing the fabric or knit article.

In another aspect, this invention relates to a method for lowering heat history characteristics and the degree of crystallinity of a synthetic fiber, lowering the temperature at which the fiber can be texturized and lowering the temperature at which the fiber absorbs dye comprising applying to the fiber to a pick-up of 0.4–0.75% by weight of a composition comprising a cycloaliphatic diester and a high boiling aromatic ester, wherein the ratio of cycloaliphatic diester to high boiling aromatic ester is 0.1:1 to 2:1 and wherein the combination of cycloaliphatic diester and high boiling aromatic constitutes 10–90% by weight of the composition and texturing the thus-coated fiber at 180°–230° C. Moreover, aforesaid composition can contain a dye-levelling agent of the formula $R_3COOR_4$.

DETAILED DISCUSSION

Figure 1:
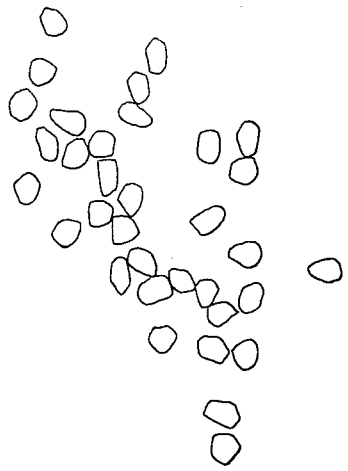
In FIG. 1–4 are shown representations of photomicrographs of polyester yarn treated with the composition of Example 15 and with a conventional spin finish composition.

The dibasic acid employed in making the compositions of this invention is a Diels-Alder adduct of acrylic acid and linoleic acid and can be prepared as described by Ward in U.S. Pat. No. 3,753,968. The diacid has the formula

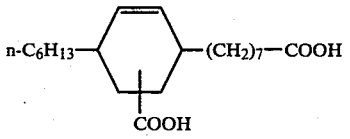

and therefore is a mixture of (5 and 6)-carboxy-4-hexyl-2-cyclohexene-1-octanoic acids. The diacid is available commercially from Westvaco, designated as "Diacid 1500".

The diacid can be esterified with alcohols using, for example, acidic catalysts such as p-toluenesulfonic acid, methanesulfonic acid or sulfuric acid. During the esterification, the reaction mixture is preferably also treated with a decolorizing agent, e.g., carbon or clay.

The diacid is reduced following esterification to a compound in which A is $—CH_2CH_2—$. A nickel catalyst such as Raney Nickel, nickel on kieselguhr or nickel on alumina can be used. The required amount varies up to 5–10% by weight of the ester.

Hydrogenation is carried out after esterification to prevent nickel from complexing with the free acid. Other catalysts, e.g., platinum or rhodium, avoid this problem, but are prohibitive in cost. The catalyst can be removed by filtration through a plate and frame filter press. The product is the resulting filtrate.

Polyoxyalkylene diesters are prepared by reaction of the diacid, in the presence of an alkaline catalyst, with ethylene or propylene oxide. Reaction will occur at both acid sites and addition of ethylene oxide is allowed to continue until the product becomes at least dispersible or, preferably, soluble in water. This will correspond to addition of a total of 5–25 ethylene oxide units. The product obtained using ethylene oxide has a structure before hydrogenation represented by the formula:

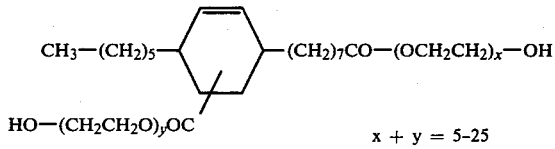

The phosphorylated product is readily obtained by reaction with phosphorus pentoxide. The saturated diester can be obtained by nickel-catalyzed hydrogenation.

In the case of the phosphorylated derivative, hydrogenation should precede phosphorylation. The phosphorylated derivatives can be converted to salts thereof by reaction with a metal hydroxide. Sodium and potassium salts are preferred.

It will be understood that the diesters used in the compositions of this invention have somewhat varying properties. However, the following general correlation between structure and properties of representative preferred diesters (hydrogenated form) can be made:

| | |
|---|---|
| dilauryl ester | liquid, good heat stability, |
| bis(2-ethylhexyl)ester | liquid, good heat stability, good lubricant |
| distearyl ester | solid, good heat stability, good lubricant |
| bis(ethoxylated)ester (15 moles ethylene oxide) | solid, heat stable, cohesive |
| bis(phosphated ethoxylated)ester (15 moles ethylene oxide) | solid, heat stable, cohesive, antistatic |

Preferred diesters for use in accordance with the principles of the invention are those wherein: A is $—CH_2CH_2—$ and (a) R is straight or branched chain alkyl of 4–20 carbon atoms,
(b) R is 2-ethylhexyl, lauryl or stearyl,
(c) R is $HO(CH_2CH_2O)_nCH_2CH_2—$,
(d) R is $HO(C_3H_6O)_nC_3H_6—$,
(e) R is $HO(C_2H_4O)_p(C_3H_6O)_qC_3H_6—$, and
(f) R is $(HO)_2\overset{O}{\overset{\|}{P}}O(CH_2CH_2O)_nCH_2CH_2—$ or a salt thereof.

It will be understood that the textile-treating compositions can contain more than one diester, e.g., a mixture of bis(alkyl) esters or a mixture containing a bisalkyl ester in combination with a bis(polyoxyalkylene) or bis(phosphated polyoxyalkylene) ester of a corresponding salt.

"High boiling aromatic ester" as used in the specification and claims means an ester of the formula $ArCOO-R_1-OOCAr$ or $ArCOOR_2$, wherein Ar is monocyclic aryl of up to 10 carbon atoms; $R_1$ is alkylene of 2–8 carbon atoms or polyoxyalkylene of the formula $—C_rH_{2r}(O-C_rH_{2r})_s$ in which r is 2 or 3 and s is up to 15; and $R_2$ is alkyl or alkenyl of 8–30 carbon atoms.

Accordingly, aromatic esters used in the practice of this invention include, but are not limited to, esters of benzoic, toluic, dimethylbenzoic, trimethylbenzoic, butylbenzoic and similar acids.

In the case of aromatic diesters, alkylene ($R_1$) can be ethylene, propylene, hexylene, 2,2-dimethyl-trimethylene, butylene, heptamethylene and octylene, including various isomers thereof.

Polyoxyalkylene diesters include those derived from polyethylene glycol or polypropylene glycol.

In the case of monoaromatic esters, alkyl can be octyl, nonyl, decyl, dodecyl, tridecyl, hexadecyl, stearyl and alkenyl can be any corresponding monounsaturated function, e.g., oleyl.

Preferred aromatic diesters are those wherein:

(a) Ar is phenyl,
(b) Ar is tolyl,
(c) $R_1$ is ethylene or propylene, including each of (a) and (b),
(d) $R_1$ is ethyleneoxyethylene or propyleneoxypropylene, including each of (a) and (b),
(e) $R_1$ is polyoxypropylene of molecular weight 200–500, including each of (a) and (b), and
(f) $R_2$ is decyl, dodecyl, hexadecyl, tridecyl, octadecyl or oleyl, including each of (a) and (b).

It has been found that aromatic esters falling outside of the foregoing definition, more particularly methyl, ethyl, propyl, butyl, pentyl and hexyl benzoates, lack heat stability, low odor and lubricating properties required for the plurality of functions fulfilled by the compositions of this invention.

Ethoxylated castor oil used in the compositions will contain 15–100 oxyethylene units, preferably 40–85. The hydrogenated castor oil derivatives will contain 5–200 oxyethylene units, preferably 20–30. These materials can be purchased from ICI America and Whitestone Chemical.

Ethyoxylated alkyl phenols used in the compositions of this invention will contain up to 12 carbon atoms in the alkyl function and from 1–25 ethylene oxide units. Preferred examples are ethoxylated nonylphenol having 10–15 ethylene oxide units.

Ethoxylated alkanols include those derived from 12–15 carbon alkanols, including mixtures thereof, or from secondary alcohols of 11–15 carbon atoms, also including mixtures, and containing 6–15 ethylene oxide units.

Phosphated ethoxylated alkanols or phenols employed in the compositions of the invention will generally have fewer ethyleneoxide units than the unphosphated compounds. Exemplary, but not limitative, of the materials which can be used are the potassium salts of POE (10) nonylphenol phosphate, POE (3.5) lauryl alcohol phosphate, POE (7) lauryl alcohol phosphate, POE (9) lauryl alcohol phosphate, POE (6) decyl alcohol phosphate, and POE (9) decyl alcohol phosphate. It will be understood that the formula given for the phosphated ethoxylated derivatives includes various products, including phosphated mono- and diesters, obtained by reaction between the ethoxylated diacids and $P_2O_5$.

In many cases, the composition of this invention will be left on the fiber during dyeing and will therefore function as dyeing assistants in which case, 10–25% by weight of a dye-levelling agent will be included. "Dye-levelling agent," as used in the specification and claims, will be of the formula $R_3COOR_4$, wherein $R_4$ is an ethoxylated alkylphenol residue of the formula

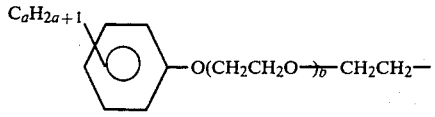

a is 0–12 and b is 1–24 or an ethoxylated alkanol residue of the formula $$CH_3(CH_2)_c—O—(CH_2CH_2O)_d—CH_2CH_2—$$

c is 7–12 and d is 1–24 and wherein $R_3$ is linear or branched alkyl or alkenyl of 1–21 carbon atoms, phenyl or tolyl.

Accordingly, exemplary dye-levelling agents include laurate, myristate, palmitate, coconate, oleate, stearate, isostearate, benzoate and toluate esters of ethoxylated nonylphenol, octylphenol, dodecylphenol, n-decanol, n-dodecanol, n-tetradecanol or n-hexadecanol. The extent of ethoxylation is from 1–25 ethylene oxide units per alkylphenol or alkanol, preferably 6–15 ethylene oxide units.

Preferred dye-levelling agents are those wherein:

(a) $R_3$ is of 11–17 carbon atoms, including mixtures thereof;
(b) $R_3$ is n-$C_{17}H_{33}$;
(c) $R_3$ is n-$C_{17}H_{35}$;
(d) $R_3$ is iso-$C_{17}H_{35}$;
(e) $R_3$ is phenyl;
(f) $R_3$ is n-$C_{11}H_{23}$;
(g) a is 9, including each of (a)-(f);
(h) c is 11–14, including mixtures thereof and including each of (a)-(f);
(i) b is about 9.5, including each of (a)-(f);
(j) d is 6–10, including each of (a)-(f);
(k) b is 6–15, including each of (a)-(f); and
(l) a is 9, b is 8–10 and $R_3$ is n-$C_{11}H_{23}$.

The compositions are especially suited for treatment of synthetic fibers such as polyester, polyamide, and polyacrylic. The polyester may be spun or textured polyester or filament or warp yarn and may be woven, knitted, tufted, needle punched or non-woven. The polyester can be a polyalkylene terephthalate, such as polyethylene terephthalate, or a polyester made from cyclohexane-dimethanol. The polyamide may be of types 6; 6,6 or 6,10. The acrylic may be straight acrylic (acrylonitrile) or modacrylic (modified with vinyl chloride, vinylidene chloride). The compositions are also adapted for application to blends of the above fibers with each other and with cellulosics (cotton, rayon, etc.) of wool.

The compositions can be applied at any of several stages of fiber processing. The following are exemplary of application to polyester fiber:

A. Spin Finish Application:

The composition is applied to the yarn from a 10–20% emulsion to give a finish level on the yarn of of 0.25–10%. The treated yarn can be built into yarn packages which can be used in high speed texturizing machines.

Compositions used as spin finishes will preferably have the following compositional range:

| | Parts by Weight |
|---|---|
| Cycloaliphatic diester | 20–40 |
| High Boiling Aromatic Ester | 20–40 |
| Dye Levelling Agent | 10–20 |
| Emulsifiers, depersing agents and/or anti-static agents | 20–30 |

Most preferably, the compositions will contain 25–35 parts by weight of the cycloaliphatic diester and 25–35 parts by weight of high boiling aromatic ester.

Spin finish compositions will preferably contain a cycloaliphatic diester in which R is alkyl of 4–20 carbon atoms, most preferably 6–12 carbon atoms.

The high boiling aromatic ester will preferably be of a glycol, most preferably diesters from ethylene, propylene, or butylene glycol and benzoic or toluic acid.

The dye-levelling agent is preferably an ethoxylated nonylphenol ester, especially of nonylphenol.

The emulsifiers, etc. will preferably comprise ethoxylated castor oil, ethoxylated hydrogenated castor oil and phosphated ethoxylated alkylphenol in ratios of 1:2:2 to 1:3:3 by weight.

A most preferred spin finish composition will consist essentially of:

| | Parts by Weight |
|---|---|
| Cycloaliphatic bis(2-ethylhexyl)ester | 25–35 |
| Propylene glycol dibenzoate | 25–35 |
| Ethoxylated nonylphenol laurate | 10–20 |
| Ethoxylated castor oil | 4–6 |
| Ethoxylated hydrogenated castor oil | 8–12 |
| Ethoxylated nonylphenol-phosphate, K salt | 8–12 |

The spin finish compositions can be diluted with water to form a stable emulsion or dispersion for application. The spin finish is preferably applied to produce a pick-up of 0.4–0.75% by weight.

A representative polyester treated to 0.5–0.6% pick-up with the spin finish composition of this invention has lower heat history characteristics than yarn treated with a conventional spin finish. Yarns thus treated can therefore be texturized at lower temperatures than possible heretofore and dyed at lower temperatures than previously used. In addition, the spin finish does not smoke or fume during texturizing at 200°–240° C. In the case of spun yarns, the finish enhances the cohesive properties of the yarn and provides the desired lubricity during picking, cording, drawing, roving and spinning.

It is recommended that, once the spin finishing compositions of this invention have been applied, no conventional lubricants be used, so as to prevent adulteration of the finishes. Maximum benefit is obtained by exclusive use of the compositions of the invention through conversion of the treated yarn to piece goods and dyeing.

B. Knitting Application:

The composition is applied to a knitting lubricant and is left on the yarn during subsequent yarn processing. That is, the lubricant need not be scoured off as are conventional lubricants. The capability of omitting a previously required processing step is an important advantage in utilizing the teachings of this invention. During weaving or knitting, high temperatures are reached due to friction and speeds, but the lubricants in accordance with the invention remain functional and do not gum up or build up on equipment. In the dyeing stage, the lubricant/dyeing assistant does not break down during the dyeing cycle (250°–270° F.) and/or smoke during drying and heat setting of the fiber. Elimination of hazy blue smoke during drying and heat setting is important because of increasingly stringent standards against air pollution.

The lubricant compositions of this invention preferably will be of the following composition:

| | Parts by Weight |
|---|---|
| Cycloaliphatic diester | 10–30 |
| High boiling aromatic ester | 30–60 |
| Dye-levelling agent | 10–30 |
| Emulsifiers, etc. | 10–30 |

Most preferably, the composition will contain 15–25 parts by weight of cycloaliphatic diester, 35–45 parts by weight of high boiling aromatic ester and 15–25 parts by weight of dye-levelling agent.

The preferred cycloaliphatic diester and dye-levelling agent are as for the spin-finishing composition. However, the high boiling aromatic is preferably a dibenzoate or ditoluate of di- or triethylene glycol or di- or tripropylene glycol.

The conventional emulsifier and anti-static agents preferably are ethoxylated alkylphenols and the corresponding phosphate esters, most preferably ethoxylated nonylphenol.

Other materials in the lubricant composition can include an anti-oxidant, such as butylated hydroxytoluene, in an amount of up to 0.5% by weight; an alkanolamine, such as triethanolamine, in an amount up to 5.0% by weight, and up to 2.5% by weight of water.

A most preferred lubricant composition comprises:

| | Parts by Weight |
|---|---|
| Cycloaliphatic bis(2-ethylhexyl)-ester | 25–35 |
| Dipropylene glycol dibenzoate | 35–45 |
| Ethoxylated nonylphenol laurate | 15–25 |
| Ethoxylated nonylphenol | 5–15 |
| Butylated hydroxytoluene | 0.05–0.2 |
| Ethoxylated nonylphenol phosphate | 5–10 |
| Triethanolamine | 1–5 |
| Water | 1–2 |

For satisfactory performance, the take up, expressed as minimum percent extractables, when the treated fabric or fiber is loaded into the dyeing machine, should be at least:

| | Minimium % extractable |
|---|---|
| Cycloaliphatic diester | 0.075 |
| High boiling aromatic ester | 0.075 |
| Dye-levelling agent | 0.050 |

Add-on levels will vary depending on the point in the fiber processing at which the lubricant is applied, but will be from about 0.25 to about 5.0% by weight of the fiber. During knitting, the add-on is preferably 0.5–1.5% by weight.

Another type of knitting lubricant prepared in accordance with the invention will be of the composition:

| | Parts by Weight |
|---|---|
| Cycloaliphatic diester | 5–15 |
| High boiling aromatic ester | 30–50 |
| Dye-levelling agent | 5–15 |
| Emulsifiers, etc. | 10–20 |
| Ethylene oxide-propylene oxide copolymer | 10–30 |

The knitting lubricants may also contain up to 0.25% by weight of an anti-oxidant and up to 5% by weight of an alkanolamine, e.g., dibutylethanolamine.

It is preferred that the knitting lubricants contain a cycloaliphatic diester in which R is alkyl of 4–20 carbon atoms, more preferably 6–12 carbon atoms.

The preferred high boiling aromatic ester will be a dibenzoate or ditoluate of ethylene or propylene glycol. Propylene glycol dibenzoate is particularly preferred.

The dye-levelling agent used in the knitting lubricant composition is preferably an ester of an ethoxylated alkanol, more preferably the decanoate, laurate, myristate or palmitate of ethoxylated decyl, lauryl, myristyl or hexadecyl alcohols.

Ethoxylated alkanols and corresponding phosphates are preferred emulsifiers in the knitting lubricant.

Ethylene oxide-propylene oxide copolymer of molecular weight 2000–5000 is preferred.

A most preferred knitting lubricant is:

| | Parts by Weight |
|---|---|
| Cycloaliphatic bis(2-ethylhexyl)ester | 8–12 |
| Propylene glycol dibenzoate | 35–45 |
| Ethoxylated lauryl laurate | 8–12 |
| Ethoxylated lauryl alcohol | 8–12 |
| Butylated hydroxytoluene | 0.5–2 |
| Ethylene oxide-propylene oxide copoylmer | 20–25 |
| Ethoxylated lauryl alcohol phosphate | 3–6 |
| Dibutylethanolamine | 1–3 |

The lubricant is applied by dripping or misting on to the needles to an uptake of 1–2% on the yarn. The thus-applied composition provides fiber-metal and metal-metal lubrication at temperatures of 100°–150° F. The composition does not break down or gum up the knitting machine.

The foregoing lubricants, if left on the cloth or yarn during the dyeing step, promote uniform dye uptake. In fact, their presence aids dye exhaustion at 240°–270° F. The lubricants do not cause excessive foaming or affect fastness properties of the dyed fabric.

Use of these compositions substantially reduces or eliminates carrier odor and smoke inside and outside processing plants. In addition to reducing air pollution, use of the lubricant compositions of this invention reduces water pollution. Generally, plant surcharges for high BOD/COD or separable oils become unnecessary.

C. Application as Coning Oil:

For use as a coning oil, intended for application after texturing or during winding of the yarn, the compositions of this invention will also contain a major amount, up to 70% by weight, of ethylene oxide-propylene oxide copolymers of molecular weight 2000–5000. Exemplary of an appropriate materials are Ucon® LB and HB (Union Carbide Corp.), the Pluronics® (BASF) or Jeffox fluids (Texaco, Inc.).

Coning oil compositions in accordance with the invention will include:

| | Parts by Weight |
|---|---|
| Cycloaliphatic diester | 5–10 |
| High boiling aromatic ester | 5–10 |
| Dye-levelling agent | 2–5 |
| Emulsifiers, dispersing agents and/or anti-static agents | 10–20 |
| Ethylene oxide-propylene oxide copolymer | 60–70 |

Preferred cycloaliphatic diesters for coning oil compositions include those in which R is alkyl of 4–20 carbon atoms, most preferably 6–12 carbon atoms.

The high boiling aromatic ester will preferably be of an alkanol of 8–30 carbon atoms, more preferably decyl, lauryl or myristyl benzoate or toluate.

The dye-levelling agent will preferably be an ester of ethoxylated alkylphenol, more preferably of nonylphenol.

The emulsifiers will preferably be ethoxylated alkanols, the corresponding phosphates and ethoxylated hydrogenated castor oil.

Other ingredients in the coning oil compositions can include up to about 0.5% by weight of an antioxidant, such as butylated hydroxytoluene; up to about 2.5% by weight of an alkanolamine, such as triethanolamine and up to 2.5% by weight of water.

A most preferred coning oil formulation is:

| | Parts by Weight |
|---|---|
| Cycloaliphatic bis(2-ethylhexyl)ester | 6–8 |
| Lauryl benzoate | 6–8 |
| Ethoxylated nonylphenol coconate | 2–4 |
| Ethoxylated lauryl alcohol | 8–12 |
| Ethoxylated hydrogenated castor oil | 2–4 |
| Ethoxylated nonylphenol phosphate | 2–4 |
| Ethylene oxide-propylene oxide copolymer | 60–70 |
| Butylated hydroxyltoluene | 0.05–0.2 |
| Triethanolamine | 0.5–2 |
| Water | 0.5–2 |

Coning oil in accordance with the invention penetrates the fiber rapidly, but does not sling off the fiber or feeder roll during application. The treated yarn is lubricated sufficiently for the yarn to be rapidly coned, knitted or woven. The composition is stable and does not smoke, yellow or discolor at temperatures up to about 150° F.

D. Dyeing:

Dyeing assistant compositions in accordance with the invention will consist of:

| | Parts by Weight |
|---|---|
| Cycloaliphatic diester | 20–40 |
| High boiling aromatic ester | 20–50 |
| Dye-levelling agent | 10–25 |
| Emulsifiers, etc. | 10–30 |

The cycloaliphatic diesters utilized for this aspect of the invention will preferably be those wherein R is alkyl of 4–20 carbon atoms, preferably of 6–12 carbon atoms.

Preferred high boiling aromatic esters for this utility are dibenzoates and ditoluates of mono- and diethylene or propylene glycols.

Dye-levelling agents preferred for this aspect of the invention will be esters of the ethoxylated alkylphenols, particularly ethoxylated nonylphenol.

It is preferred that dyeing assistant compositions also contain ethoxylated castor oil and ethoxylated hydrogenated castor oil, as well as the phosphate (potassium salt) of an ethoxylated cycloaliphatic diester, that is, R is phosphated polyoxyethylene.

Preferably, the dyeing assistant compositions will contain 25–35 parts by weight of cycloaliphatic diester, 35–45 parts by weight of high boiling aromatic ester and 10–20 parts by weight of dye-levelling agent.

A most preferred dyeing assistant composition will contain:

| | Parts by Weight |
|---|---|
| Cycloaliphatic bis(2-ethylhexyl)ester | 25–35 |
| Dipropylene glycol dibenzoate | 35–45 |
| POE nonylphenol laurate | 10–20 |
| POE castor oil | 4–6 |
| POE hydrogenated castor oil | 8–12 |
| POE cycloaliphatic diester phosphate, K salt | 8–12 |

The composition is applied to the dyebath at a level of 0.25%, based on the weight of the goods. The dye bath is acidic (pH=5±0.5) and contains dye as the only additional ingredient. This is unlike conventional processing requiring a dyeing assistant of 2–4% and other auxiliary levelling agents. Furthermore, the dyeing cycle is less sensitive to rate of temperature change than conventional systems. The dyeing temperature in both systems is usually 265° F. in jet dyeing equipment.

Dyed yarns obtained using the compositions of the invention compare favorably with conventionally dyed yarn in properties such as light-fastness, crocking, shade depth and levelness.

Accordingly, the compositions of this invention, applied to a synthetic fiber when manufactured, or used as a processing aid for texturizing instead of prior art lubricants, both improve the dye affinity of the fiber and generally eliminate the need for further downstream processing and consumption of chemicals associated therewith.

Typical processes or treating agents eliminated include:

(1) Lubricants during knitting or weaving
(2) Scour and removal of lubricant
(3) Dye carrier during dyeing
(4) Dye dispersant during dyeing
(5) Dye leveller during dyeing
(6) Fiber lubricant during dyeing
(7) Defoamer during dyeing
(8) Afterclean and scour after dyeing
(9) Winding lubricant for dyed yarn.

DESCRIPTION OF MOST PREFERRED EMBODIMENT

A most preferred general purpose textile-treating composition consists essentially of:

| | Percent by Weight |
|---|---|
| Bis(2-ethylhexyl)cycloaliphatic ester | 15–25 |
| Propylene glycol dibenzoate | 30–50 |
| Polyoxyethylenenonylphenol laurate | 15–20 |
| Polyoxyethylene hydrogenated castor oil | 5–15 |
| Polyoxyethylene castor oil | 5–15 |

Without further elaboration, it is believed that one skilled in the art can, using the preceding description, utilize the present invention to its fullest extent. The following specific embodiments are, therefore, to be construed as merely illustrative and not limitative of the remainder of the disclosure in any way whatsoever. In the following examples, the temperatures are set forth uncorrected in degrees Celsius. Unless otherwise indicated, all parts and percentages are by weight.

EXAMPLE 1

Preparation of Dialkyl Ester (A is —$CH_2CH_2$—, R is 2-ethylhexyl).

To three-necked flask fitted with stirrer, thermometer, nitrogen purge, condenser, side-arm receiver and heating mantle were charged 352 g (1 mole) of Diacid 1550, 273 g (2.1 moles) of 2-ethylhexanol, 1.5 g of p-toluenesulfonic acid and 2 g of decolorizing carbon. Air was purged from the flask with nitrogen and the reaction mixture was stirred and heated to 160°–170° C. for 4–6 hours. Water formed during the reaction was collected in the side arm receiver. The reaction was continued until the acid value was below 5 mg KOH/g. The catalyst and carbon were removed by filtration. The ester product and 25 grams of nickel on kieselguhr were charged to a stirred, heated pressure vessel. The mixture was heated to 160°–170° C. and pressurized to 400 psig with hydrogen. A sample was taken after 6–8 hours and the iodine value was determined. The reaction was continued until the iodine value was below 0.5 g of iodine/100 g of sample.

The product was cooled to 50° C. and the catalyst removed by filtration.

Esters are prepared similarly from:

(1) Diacid 1550 and decyl alcohol, 1:2 molar ratio
(2) Diacid 1550 and tridecyl alcohol, 1:2 molar ratio
(3) Diacid 1550 and Neodol 25, a mixture of $C_{12}$–$C_{15}$ linear alcohols, 1:2 molar ratio
(4) Diacid 1550 and butanol, 1:2 molar ratio.

EXAMPLE 2

A. Preparation of Polyoxyethylene Diester (A is —CH=CH—, R is $HO(CH_2CH_2O)_nCH_2CH_2$—).

To a stirred autoclave fitted with heating and cooling coils was charged 352 g (1 mole) of Diacid 1550. Catalyst (1.0 g of potassium hydroxide) was charged to the reactor. The temperature was raised to 110° C. and the reactor was vacuum stripped for 30–60 minutes to remove any residual water from previous washing of the reactor or from one or more of the charged reactants or catalyst. The reactor was purged with nitrogen to remove air, evacuated again and purged again with nitrogen. It was stirred and heated to 140° C. and 100 g (2.3 moles) of ethylene oxide was added to the reactor. The pressure inside the reactor immediately built up to 30–50 psig. After 30–60 minutes induction time, an exothermic polymerization reaction (to 150°–160° C.) began with an accompanying pressure drop to zero (0 psig) as ethylene oxide was consumed. Ethylene oxide was added to the reactor to a total of 660 grams (15 moles). The temperature was maintained at 150°–160° C. by cooling. Addition of ethylene oxide was stopped and the reaction was allowed to continue for an additional 30 minutes. The reactor was cooled to 90°–100° C. and purged twice with nitrogen.

A sample of the product had a hydroxyl value of 110 mg of KOH/g (15 moles of ethylene oxide added to the diacid). The diester was acidified with acetic acid to neutralize the potassium hydroxide catalyst and 3 g of hydrogen peroxide was added to bleach and lighten the color of the product. The reactor was cooled to 30° C. and the product was filtered through filter paper using a porcelain filter.

B. Reduction to the Polyoxyethylene Diester (A is —$CH_2CH_2$—).

The product of Example 2A and 25 g of nickel on kieselguhr were charged to a stirred, heated pressure vessel. The mixture was heated to 160°-170° C. and pressurized with hydrogen to 400 psig. After 6-8 hours, samples were removed at intervals for determination of the iodine value. The reaction was continued until the iodine value was less than 0.5 g/100 g of sample.

EXAMPLE 3

Preparation of Phosphated Polyoxyethylene Diester (A is $-CH_2CH_2-$, R is $$(HO)_2\overset{\overset{\displaystyle O}{\|}}{P}O(CH_2CH_2O)_nCH_2CH_2-).$$

Polyethoxylated (15 moles) diacid, obtained as in Example 2B was heated to 50°-60° C., stirred and purged thoroughly with nitrogen to remove air. To about 1015 g (1.0 mole) of this material was added 24 g (0.17 mole) of $P_2O_5$. An immediate exothermic reaction occurred (exotherm to 85°-95° C.). The reaction mixture was maintained at this temperature by cooling and an additional 24 g (0.17 mole) of $P_2O_5$ was added. The reaction was continued for 3 hours after all the $P_2O_5$ was added. The reactor was cooled to 50° C. prior to removal of a sample. The product had an acid value of 32 mg KOH/g (indicates the reaction is complete). The batch was bleached at 85°-95° C. with 5 g of hydrogen peroxide, cooled to 30° C. and filtered.

EXAMPLE 4

Preparation of Propylene Glycol Dibenzoate.

To a 3-necked flask fitted with stirrer, condenser, receiver, thermometer, nitrogen purge and heating mantle were charged 84 g (1.1 mole) of propylene glycol, 244 g (2 moles) of benzoic acid and 0.8 g of p-toluenesulfonic acid. Air was purged from the flask with nitrogen and the contents of the flask were heated to 160°-170° C. Water formed by the reaction was removed continuously. The reaction was continued until the product had an acid value below 5 mg KOH/g. The sample was cooled and filtered.

Other esters are prepared using the following reactants:

(1) dipropylene glycol and benzoic acid, 1:2 molar ratio
(2) PPG 200 and benzoic acid, 1:2 molar ratio
(3) PPG 500 and benzoic acid, 1:2 molar ratio.

EXAMPLE 5

Preparation of Polyoxyethylene Nonylphenyl Laurate.

To a three-necked flask fitted out as in Example 4 was charged 750 g (1.1 mole) of polyoxyethylated and nonylphenol (9.5 moles of oxyethylene, NP 9.5), 208 g (1 mole) of lauric acid and 2.4 g of p-toluenesulfonic acid. Air was purged from the flask with nitrogen and the mixture was heated to 160°-170° C. until an acid value below 10 mg KOH/g was obtained. The product was cooled and filtered.

Other polyoxyethylene nonylphenyl esters are made in a similar fashion from:

(1) NP 9.5 and coconut fatty acid, 1:1 molar ratio
(2) NP 9.5 and oleic acid, 1:1 molar ratio
(3) NP 9.5 and stearic acid, 1:1 molar ratio
(4) NP 9.5 and benzoic acid, 1:1 molar ratio.

EXAMPLE 6

Ethoxylated castor and hydrogenated castor oils were prepared as in Example 2. Ethylene oxide adds to the hydroxyl group of castor oil.

EXAMPLE 7

A textile-treating composition was made by combining materials prepared as above in the following amounts by weight:

| | % by weight |
|---|---|
| Bis-2-ethylhexyl diester (Example 1) | 20 |
| Propylene glycol dibenzoate | 40 |
| Polyethoxyethylene nonylphenol laurate (9.5 moles ethylene oxide) | 20 |
| Polyethoxyethylene hydrogenated castor (25 moles ethylene oxide) | 10 |
| Polyethoxyethylene castor (80 moles ethylene oxide) | 10 |

EXAMPLE 8

The textile-treating composition of Example 7 was applied during the dyeing cycle to a 10 g swatch of T56 textured polyester test fabric by the following technique:

The sample swatch was placed in a stainless steel beaker containing 150 ml of water, 0.067 g of disperse yellow 67, 0.091 g of disperse red 91, 0.026 g of disperse blue 56, 0.1 g acetic acid (56%) and 0.03 g of the textile-treating composition. The beaker was sealed and placed in a launderometer set at 38° C. The temperature was raised at 4°-5° C. per minute to 130° C. and held for 30 minutes. The beaker was cooled at 4°-5° C. per minute to 52° C. and removed from the launderometer. The polyester swatch was removed from the beaker. It was uniformly dyed in a medium brown shade. Nearly all of the dye was exhausted from the aqueous solution. The swatch was rinsed with cool water and dried in an oven at 121° C.

EXAMPLE 9

Texturized polyester doubleknit (1500 pounds) were loaded into a 6 port Gaston County jet machine. The machine was filled with water and the goods given an overflow wash. The machine was refilled and ramped to 60° C. Fifteen pounds of acetic acid (56%) and 4.5 pounds of the compositions of Example 7 were dropped into the jet from the drug room. After 5 minutes, 18 pounds of Samaron Yellow 6 GSL (disperse yellow 114), 15 pounds of Bucron Rubine 2BNS (disperse red) and 13 pounds of Foron Blue SBGL (disperse blue 73) were added to the jet machine from the drug room. The jet was sealed off and ramped to 130° C. The temperature was held for 30 minutes at 130° C. and ramped back to 66° C. The fabric was patched for shade, the shade matched standard. The temperature was dropped to 38° C. The spent dye liquor was dropped and the machine refilled with water. The goods were rinsed thoroughly and removed from the jet. The goods were slit, dried and inspected. Final inspection indicated goods of excellent quality.

During the dyeing cycle using the composition of Example 7, the odor level in the dye house was much lower than observed with conventional systems. Little smoking from the ovens was observed during drying and heat setting at the end of the dyeing cycle. Employee comfort was therefore significantly improved.

The dyeing assistant undergoes facile degradation upon being fed to the plant effluent. The following values were obtained:

| | Conventional System | Dye Assistant As Above |
|---|---|---|
| COD mg/kg | 2,640,000 | 2,210,000 |
| BOD mg/kg | <2,000 | 750,000 |
| Ratio, COD:BOD | >1300:1 | 2.95:1 |

Because little of the dyeing assistant remains on the fabric after dyeing, use of the product of Example 7 does not affect fastness properties of the dyed goods.

The foregoing is typical of production-scale application of the composition.

EXAMPLE 10

The procedure of Example 9 was repeated, except that no composition of Example 7 was used. Upon patching at the end of the dyeing cycle, the shade is slightly off due to incomplete dye exhaustion. The bath temperature was taken back up to 132° C. and held an additional 30 minutes. The next patch indicated the shade matched the standard, whereupon the goods were rinsed, removed, slit and dried. Upon inspection, the goods were found to have dye streaks, rope marks, bad barre coverage and a generally unlevel dyeing from end to end and piece to piece. The goods had to be reworked by being loaded back into a dyeing machine and treated with additional dye and levelling agents. The goods were kept in the machine for 3–4 hours until a level dyeing was achieved, but the fabric had a poor appearance as a result of prolonged processing.

This comparative example shows that omission of the composition of the invention produces an unacceptable dyeing.

EXAMPLE 11

A textile-treating composition is prepared from the following ingredients:

| | % by weight |
|---|---|
| bislauryl diester (Example 1) | 20 |
| dipropylene glycol dibenzoate | 40 |
| POE (9.5) nonylphenol coconate | 20 |
| POE (80) castor oil | 10 |
| POE (25) hydrogenated castor oil | 10 |

This composition is comparable in properties with the composition of Example 7.

EXAMPLE 12

A textile-treating composition is prepared as in Example 7, except that 22% by weight of polyoxyethylene diester (Example 2B) and 28% by weight of propylene glycol dibenzoate were used. The composition enhances processing of polyester fabric as described in Example 9.

EXAMPLE 13

A textile-processing composition is prepared as in Example 7, except that 18% by weight of phosphated polyoxyethylene diester (Example 3) and 42% by weight of dipropylene glycol dibenzoate are used. The composition improves the processing of polyester fabric and acts as an anti-static agent.

EXAMPLE 14

(a) A textile-treating composition was prepared as in Example 7 from the following:

| | Percent by Weight |
|---|---|
| Cycloaliphatic bis(2-ethylhexyl) ester | 30.0 |
| Dipropylene glycol dibenzoate | 30.0 |
| POE (9.5) nonylphenol laurate | 15.0 |
| POE (80) castor oil | 5.0 |
| POE (25) hydrogenated castor oil | 10.0 |
| POE (15) diester phosphate potassium salt (Example 3) | 10.0 |

(b) The composition thus obtained was applied from a 20% aqueous solution as a spin finish to 150 denier polyester fiber, which was then spun and textured. The finish of the yarn (foy) prior to texturizing was 0.29%; after texturizing foy was 0.25%. The textured yarn built a satisfactory package.

Spin finish, applied as above, did not smoke, drip, build up on heater plates or cause other undesirable running conditions.

The texturized yarn was knitted on an Invoit 18 Gauge machine into a double knit fabric. The yarn knitted well, with a minimum heat build up on the knitting machine. No haze, mist or odor was observed in the knitting plant.

The fabric was taken to the dyehouse and loaded into a 6-port Gaston County jet machine. The goods were neither overflow washed nor scoured. Foaming during loading of the fabric was significantly lower than that of fabrics treated with conventional lubricants. The fabric was dyed as in Example 9 to yield a product judged of superior quality. Both dye yield and barré coverage were improved and the fabric had a better overall appearance than untreated fabrics.

EXAMPLE 15

(a) A spin finishing composition was prepared from:

| | Parts by Weight |
|---|---|
| Cycloaliphatic bis(2-ethylhexyl) ester | 30 |
| Propylene glycol dibenzoate | 30 |
| POE (9) nonylphenol laurate | 15 |
| POE (81) castor oil | 5 |
| POE (25) hydrogenated castor oil | 10 |
| POE (10) nonylphenol phosphate, K salt | 10 |

(b) The composition of part (a) was applied, as a 20% emulsion, to polyester yarn (505 denier/34 filament) from a single merge so as to achieve 0.5–0.6% dry pick-up. The treated yarn and yarn treated with a conventional lubricant (Diamond Shamrock FT-504, containing a fatty ester lubricant, nonionic ethoxylate emulsifiers and antistat at 0.5–0.6% pick-up) were textured at 205°–220° C. on a sample Scragg X-2 texturing machine. After texturing, the treated yarns were tested for thermal and other properties. The following results were obtained:

| | Standard Spin Finish | Spin Finish of Example 15(a) |
|---|---|---|
| Tube Color | Violet/Green Striped | Orange |
| Denier (short denier method) | ~164 | ~167 |
| Filament Count | 34 | 34 |
| Density (Density gradient tube method), g/cc | 1.3883 (range of 10 samples, 0.0001) | 1.3856 (range of 10 samples, 0.0003) |
| TMA (Thermomechanical Analysis), °C. | 165° C. recheck, 168° C. | 145° C. recheck, 148° C. |
| DSC (Differential Scanning Calorimetry), °C. | 159° C. | 152° C. |
| % Lubricant (Ether Soxhlet Extraction) | 0.31 | 0.41 |

TMA is a measure of softening or melting tendency of yarn heated under a constant tension. The decrease in TMA and DSC of the test yarn indicates that the degree of crystallinity is lower than that of yarn treated with a conventional spin finish. Accordingly, treated fibers could be texturized and would absorb dyes at lower temperatures than customary, resulting in decreased energy expenditure.

Figure 2:
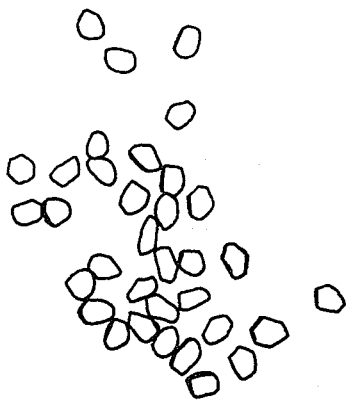
Figure 3:
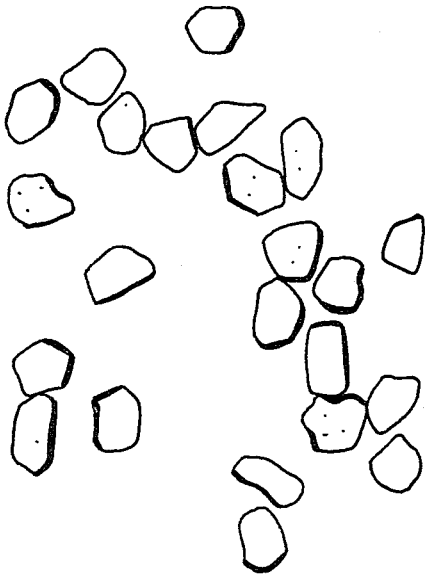
Figure 4:
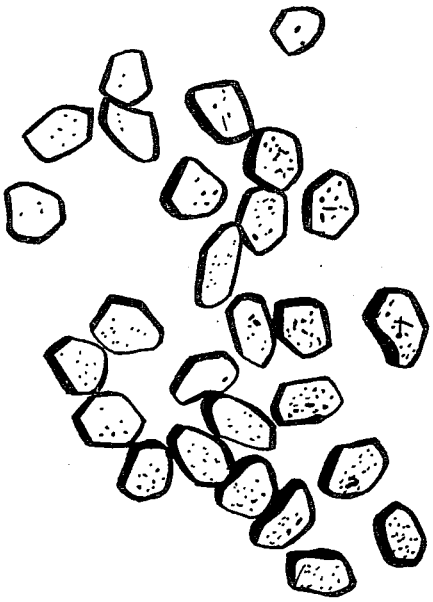

(c) Photomicrographic studies of yarn cross-sections indicated that both yarns maintained their configurations. Accordingly, it is thought that observed changes in heat history were caused by changes in crystallinity induced by the spin finish applied. Dye penetration of both yarn lots was essentially equivalent, but dye absorption of the fibers treated with the compositions of this Example are higher. The photomicrographs (FIGS. 1–4) also show that the crystallinity of the test specimens has been changed.

(d) Lubricating properties of the yarns was evaluated on the Scragg X-2 machine under varying conditions. The yarn was textured at 340 meters/min at 205°–220° C.

The following results were obtained:

| Package No. | Disc/ Yarn Speeds | Draw Ratio | Center Spindle Tension | $T_1$ | $T_2$ | Den. | Heated Shrinkage (%) | Break Shrinkage/ Elongation |
|---|---|---|---|---|---|---|---|---|
| Conventional Spin Finish: (Average) | | | | | | | | |
| 1 | 1.91 | 3.255 | 36.0 | 44 | 47 | 168 | 15 | 535/18 |
| Fiber Finish of Example 15(a): | | | | | | | | |
| 1 | 1.91 | 3.206 | 36.0 | 44 | 47 | 170 | 16 | 515/18.5 |
| 2 | 1.91 | 3.255 | 36.0 | 45 | 50 | 168 | 13 | 529/18.3 |
| 3 | 1.91 | 3.306 | 36.0 | 47 | 54 | 164 | 13 | 524/18 |
| 4 | 1.91 | 3.255 | 35.0 | 51 | 33 | 168 | 14 | 538/18 |
| 5 | 1.91 | 3.255 | 35.5 | 47 | 48 | 166 | 15 | 526/19 |
| 6 | 300 m/m | | 36.0 | 45 | 49 | 168 | 15 | 535/18 |
| 7 | 1.91 | 3.255 | 36.5 | 40 | 65 | 165 | 14 | 534/17.7 |
| 8 | 1.91 | 3.255 | 37.0 | 38 | 80 | 169 | 12 | 494/16.6 |
| 9 | 1.75 | 3.255 | 36.0 | 42 | 57 | 166 | 14 | 501/16.6 |
| 10 | 1.96 | 3.255 | 36.0 | 45 | 47 | 168 | 13 | 525/17 |
| 11 | 1.99 | 3.255 | 36.0 | 46 | 46 | 165 | 15 | 537/17 |

The frictional properties, breaking strength, elongation and heated shrinkage were judged equivalent.

(e) The effect of texturing temperature on dye uptake of yarn knitted into a sock and dyed was studied from 180°–230° C. Dye absorption by the fiber was measured using a Macbeth Color Eye instrument. The test lot was texturized using the composition of Example 15(a) and contained no other additives. The control lot contained Hipochem TA-3, a commercial dye carrier containing chlorinated solvents, methylnaphthaline and emulsifiers.

The K/S values (Kubelk-Munk/Scattering) were calculated as follows:

$$K/S = \frac{(1 - \text{reflectance})^2}{2 \times \text{reflectance}}$$

The K/S value is directly proportional to the amount of dye on the fabric.

The following results were obtained:

| Temperature °C. | K/S with Carrier | K/S with Finish of Example 15(a) | % Color Increase |
|---|---|---|---|
| 180 | 5.999 | 6.580 | 9.7 |
| 185 | 5.907 | 6.510 | 10.2 |
| 190 | 5.814 | 6.556 | 12.8 |
| 195 | 5.814 | 6.432 | 10.6 |
| 200 | 5.721 | 6.426 | 12.3 |
| 205 | 5.719 | 6.484 | 13.4 |
| 210 | 5.715 | 6.490 | 13.6 |
| 215 | 5.816 | 6.542 | 12.5 |
| 220 | 5.879 | 6.614 | 12.5 |
| 225 | 5.993 | 6.734 | 12.4 |
| 230 | 6.151 | 6.888 | 12.0 |

These results show that the test fabrics had K/S values about 10% higher than a fabric dyed using a conventional carrier. In addition, dye uptake was relatively uniform over a wide temperature range for texturing. These data further indicate that spin finish application is relatively more uniform that heretofore.

(f) Large scale quantities of polyester texturized following use of the spin finish of Example 15(a) were knitted into fabric and dyed in Gaston County Jet Machines without addition of lubricant, leveller, dyeing assistant or dye carrier. The treated polyester consistently gave 7–12% higher color yields than usual. Heat history barré seconds dropped 3–30%, depending on the style and shade.

EXAMPLE 16

Lubricant of the following composition was prepared:

| | Parts by Weight |
|---|---|
| Cycloaliphatic bis(2-ethylhexyl)ester | 20.0 |
| Dipropylene glycol dibenzoate | 39.3 |
| POE (9.5) nonylphenol laurate | 20.0 |
| POE (10) nonylphenol | 10.0 |

-continued

| | Parts by Weight |
|---|---|
| Butylated hydroxytoluene | 0.1 |
| POE (9.5) nonylphenol phosphate | 6.3 |
| Triethanolamine, 98% | 2.5 |
| Water | 1.8 |

EXAMPLE 17

Coning oil, for application at a level of 2–4% after texturizing, was prepared from:

| | Weight Percent |
|---|---|
| cycloaliphatic bis(2-ethylhexyl) ester | 7.50 |
| lauryl benzoate | 7.50 |
| POE (9.5) nonylphenol coconate | 3.75 |
| POE (3.5) lauryl alcohol | 10.00 |
| POE (25) hydrogenated castor oil | 2.50 |
| POE (10) nonylphenol phosphate | 2.50 |
| Ucon LB-65 | 64.15 |
| Butylated hydroxyltoluene | 0.10 |
| Triethanolamine | 1.00 |
| Water | 1.00 |

This coning oil provided necessary lubrication to allow the yarn to be rapidly coned, knitted or woven. It did not smoke, yellow or discolor during processing temperatures of up to 65° C.

EXAMPLE 18

Knitting lubricant in accordance with the invention was prepared from:

| | Weight Percent |
|---|---|
| Cycloaliphatic bis(2-ethylhexyl) ester | 10.0 |
| Propylene glycol dibenzoate | 41.0 |
| Lauryl (POE 9) laurate | 10.0 |
| POE (9) lauryl alcohol | 10.0 |
| Butylated hydroxyltoluene | 0.1 |
| Ucon LB-65 | 21.9 |
| POE (9) lauryl acid phosphate | 5.0 |
| Dibutylethanolamine | 2.0 |

The lubricant was applied to the knitting needles at a level of 1–2% by dripping or misting and was effective as a lubricant at 38°–65° C.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A method for lowering heat history characteristics and the degree of crystallinity of a synthetic fiber, lowering the temperature at which the fiber can be texturized and lowering the temperature at which the fiber absorbs dye comprising applying to the fiber to a pick-up of 0.4–0.75% by weight of a composition comprising a cycloaliphatic diester of the formula

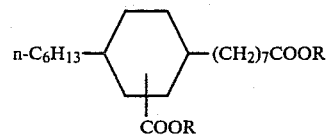

wherein R is straight or branched chain alkyl of 4–20 carbon atoms, polyoxyalkylene of the formula $HO(CH_2CH_2O)_nCH_2CH_2$—, $HO(C_3H_6O)_nC_6H_3$—$HO(CH_2CH_2O)_p(CH_3H_6O)_qC_3H_6$— or $HO(C_3H_6O)_p(C_2H_4O)_qC_2H_4$ or phosphated polyoxyalkylene, wherein n is 2–22 and the sum of p+q is n; and a high boiling aromatic ester of the formula $ArCOO\text{-}R_1\text{-}OOCAr$ or $ArCOOR_2$, wherein Ar is a substituted or unsubstituted monocyclic aryl of; $R_1$ is alkylene of 2–8 carbon atoms or polyoxyalkylene of the formula $—C_rH_{2r}(O\text{-}C_rH_{2r})_s$ in which r is 2 or 3 and s is up to 15; and $R_2$ is alkyl or alkenyl of 8–30 carbon atoms;

wherein the ratio of cycloaliphatic diester to high boiling aromatic ester is 0.1:1 to 2:1 and wherein the combination of cycloaliphatic diester and high boiling aromatic ester constitutes 10–90% by weight of the composition and texturing the thus-coated fiber at 180°–230° C.

2. The method of claim 1 wherein the composition further comprises a dye-levelling agent of the formula $R_3COOR_4$, wherein $R_4$ is an ethoxylated alkylphenol residue of the formula

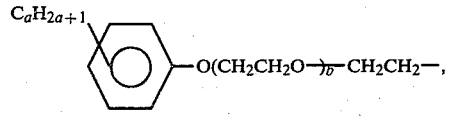

a is 0–12 and b is 1–24 or an ethoxylated alkanol residue of the formula $CH_3(CH_2)_c—O—(CH_2CH_2O)_dCH_2CH_2$—, c is 7–22 and d is 1–24 and wherein $R_3$ is linear or branched alkyl of 1–21 carbon aoms, phenyl or tolyl.

3. The method of claim 2, wherein the fiber is coated with a minimum extractable of 0.075% by weight of cycloaliphatic diester, 0.075% by weight of high boiling aromatic ester and 0.050% by weight of dye-levelling agent.

4. The method of claim 2, wherein the synthetic fiber is polyester.

5. Polyester fiber treated by the method of claim 1.

* * * * *

UNITED STATES PATENT AND TRADEMARK OFFICE

CERTIFICATE OF CORRECTION

PATENT NO. : 4,293,305

DATED : October 6, 1981

INVENTOR(S) : Robert B. Wilson

It is certified that error appears in the above—identified patent and that said Letters Patent is hereby corrected as shown below:

ABSTRACT, third line after formula: "$HO(C_3H_6O)_nC_6H_3$-, should read -- $HO(C_3H_6O)_nC_3H_6$-, -- col. 1, line 43: "vol. 57" should read -- vol. 52 -- col. 6, line 45: "etc. of" should read -- etc. or -- col. 7, line 51: "applied to" should read -- applied as -- col. 10, line 28: "Butylated hydroxyltoluene" should read -- Butylated hydroxytoluene -- col. 12, line 47: "minutes" should read -- minutes' -- col. 15, line 30: "barre" should read -- barré -- col. 18, line 1: "methylnaphthaline" should read -- methylnaphthalene -- col. 19, lines 23 and 43: "Butylated hydroxyltoluene" should read -- Butylated hydroxytoluene --

UNITED STATES PATENT AND TRADEMARK OFFICE

CERTIFICATE OF CORRECTION

PATENT NO. : 4,293,305

DATED : October 6, 1981

INVENTOR(S) : Robert B. Wilson

It is certified that error appears in the above—identified patent and that said Letters Patent is hereby corrected as shown below:

col. 20, line 20: " $HO(C_3H_6O)_nC_6H_3$-" should read -- $HO(C_3H_6O)_nC_3H_6$- -- col 20, line 21: "$HO(CH_2CH_2O)_p(CH_3H_6O)_qC_3H_6$-" should read -- $HO(CH_2CH_2O)_p(C_3H_6O)_qC_3H_6$-- col. 20, line 49: "aoms" should read -- atoms --.

Signed and Sealed this

Eighteenth Day of May 1982

[SEAL]

Attest:

GERALD J. MOSSINGHOFF

Attesting Officer

Commissioner of Patents and Trademarks

UNITED STATES PATENT AND TRADEMARK OFFICE

CERTIFICATE OF CORRECTION

PATENT NO. : 4,293,305

DATED : October 6, 1981

INVENTOR(S) : Robert B. Wilson

It is certified that error appears in the above—identified patent and that said Letters Patent is hereby corrected as shown below:

col. 2, line 39: "$-C_rH_{2r}(O-C_rH_{2r})_s$" should read — $-C_rH_{2r}(O-C_rH_{2r})_s-$ — col. 4, line 59: "$-C_rH_{2r}(O-C_rH_{2r})_s$" should read — $-C_rH_{2r}(O-C_rH_{2r})_s-$ —

Claim 1, line 28: "$-C_rH_{2r}(O-C_rH_{2r})_s$" should read — $-C_rH_{2r}(O-C_rH_{2r})_s-$ —

Signed and Sealed this

*Sixth* Day of *September 1983*

[SEAL]

*Attest:*

GERALD J. MOSSINGHOFF

*Attesting Officer*

*Commissioner of Patents and Trademarks*